US007089167B2

(12) United States Patent
Poe

(10) Patent No.: US 7,089,167 B2
(45) **Date of Patent: *Aug. 8, 2006**

(54) EVALUATION OF RESERVOIR AND HYDRAULIC FRACTURE PROPERTIES IN MULTILAYER COMMINGLED RESERVOIRS USING COMMINGLED RESERVOIR PRODUCTION DATA AND PRODUCTION LOGGING INFORMATION

(75) Inventor: Bobby Poe, Houston, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 947 days.

This patent is subject to a terminal disclaimer.

(21) Appl. No.: 09/952,656

(22) Filed: Sep. 12, 2001

(65) Prior Publication Data

US 2002/0043370 A1 Apr. 18, 2002

Related U.S. Application Data

(60) Provisional application No. 60/231,788, filed on Sep. 12, 2000.

(51) Int. Cl.
*G06G 7/48* (2006.01)

(52) U.S. Cl. ..... 703/10; 702/6; 702/12; 702/13; 703/2; 703/6; 703/9

(58) Field of Classification Search ..... 703/2, 703/6, 9, 10; 702/6, 12, 13
See application file for complete search history.

(56) References Cited

U.S. PATENT DOCUMENTS

| | | | | |
|---|---|---|---|---|
| 4,742,459 | A | 5/1988 | Lasseter | 364/422 |
| 4,803,873 | A | 2/1989 | Ehlig-Ecomomides | 73/155 |
| 5,305,209 | A | 4/1994 | Stein et al. | 364/420 |
| 5,675,147 | A * | 10/1997 | Ekstrom et al. | 250/256 |
| 5,829,520 | A * | 11/1998 | Johnson | 166/250.01 |
| 5,960,369 | A | 9/1999 | Samaroo | 702/6 |
| 6,101,447 | A * | 8/2000 | Poe, Jr. | 702/13 |
| 2002/0096324 | A1 * | 7/2002 | Poe, Jr. | 166/250.15 |

FOREIGN PATENT DOCUMENTS

| | | |
|---|---|---|
| EP | 0866213 | 9/1998 |
| GB | 2235540 | 3/1991 |

OTHER PUBLICATIONS

Osman, "Pressure Analysis of a Fractured Well in Multilayered Reservoirs", Journal of Petroleum Science and Engineering, vol. 9, Issue 1, Feb. 1993, pp. 49-66.*

(Continued)

*Primary Examiner*—Kamini Shah
*Assistant Examiner*—Herng-der Day
(74) *Attorney, Agent, or Firm*—Rodney Warfford; Tim Curington; Robin Nava

(57) ABSTRACT

A method for providing production optimization of reservoir completions having a plurality of completed intervals via available production analysis and production logging data provides a quantitative analysis procedure for reservoir and fracture properties of a commingled reservoir system, that includes the steps of measuring pressure for specific zones in a reservoir; selecting a pressure traverse model; computing midzone pressures using the traverse model; comparing the computed midzone pressures with the measured pressures; and modeling the bottomhole pressure of the reservoir based on the traverse model.

11 Claims, 2 Drawing Sheets

OTHER PUBLICATIONS

Poe, B.D. et al., *Production Data Analysis And Forecasting Using A Comprehensive Analysis System*, SPE Paper 52178 presented at the 1999 SPE Mid-Continent Operations Symposium held in Oklahoma City, Oklahoma Mar. 28-31, 1999.

Qahtani, Abdullah, *A New Technique And Field Application For Determining Reservoir Characteristics From Well Performance Data*, SPE Paper 68141 presented at the SPE Middle East Oil Shoe & Conference held in Bahrain Mar. 17-20, 2001.

Samaniego, F., et al., *On The Determination Of The Pressure-Dependent Characteristics Of A Reservoir Through Transient Pressure Testing*, SPE Paper 19774 presented at the 64th Annual Technical Conference and Exhibition of the Society of Petroleum Engineers held in San Antonio, Texas Oct. 8-11, 1999.

Poe, B.D., *Evaluation Of Reservoir And Hydraulic Fracture Properties In Geopressure Reservoirs*, SPE Paper 64732 presented at the SPE International Oil and Gas Conference and Exhibition in China held in Beijing, China Nov. 7-10, 2000.

Meinzer, O.E., *Compressibility and Elasticity Of Artesian Aquifers*, Econ. Geol. (1928) 23, pp. 263-271.

Jacob, C.E. et al. *Engineering Hydraulics*, New York (1950) pp. 321-382.

Gladfelter, R.E. *Selecting Well Which Will Respond To Production-Stimulation Treatment, Drilling and* Procustion Procedure, American Pertoleum Institute, Dallas, Texas 117-129 (1955).

* cited by examiner

INDIVIDUAL RESERVOIR INTERVAL FLOW RATES AND WELLBORE PRESSURE TRAVERSES

EVALUATION OF RESERVOIR AND HYDRAULIC FRACTURE PROPERTIES IN MULTILAYER COMMINGLED RESERVOIRS USING COMMINGLED RESERVOIR PRODUCTION DATA AND PRODUCTION LOGGING INFORMATION

CROSS REFERENCE TO RELATED PROVISIONAL APPLICATION

This application is based on Provisional Application Ser. No. 60/231,788 filed on Sep. 12, 2000.

BACKGROUND OF THE INVENTION

1. Field of the Invention

The invention is generally related to methods and processes for analyzing well production data and maximizing efficiency of reservoir production therefrom and is specifically directed to the evaluation of multilayer commingled reservoirs using commingled production data and production logging information.

2. Discussion of the Prior Art

Field production performance data and multiple pressure transient tests over a period of time for oil and gas wells in geopressured reservoirs have been found to often exhibit marked changes in reservoir effective permeability over the producing life of the wells. Similarly, the use of quantitative fractured well diagnostics to evaluate the production performance of hydraulically fracture wells have clearly shown that effective fracture half-length and conductivity can be dramatically reduced over the producing life of the wells. A thorough investigation of this topic may be found in the paper presented by Bobby D. Poe, the inventor of the subject application, entitled: "Evaluation of Reservoir and Hydraulic Fracture Properties in Geopressure Reservoir," Society of Petroleum Engineers, SPE 64732.

Some of the earliest references to the fact that subterranean reservoirs do not always behave as rigid and non-deformable bodies of porous media may be found in the groundwater literature, see for example, "Compressibility and Elasticity of Artesian Aquifers," by O. E. Meinzer, Econ. Geol. (1928) 23, 263–271. and "Engineering Hydraulics," by C. E. Jacob, John Wiley and Sons, Inc. New York (1950) 321–386.

The observations of early experimental and numerical studies of the effects of stress-dependent reservoir properties demonstrated that low permeability formations exhibit a proportionally greater reduction in permeability than high permeability formations. The stress-dependence of reservoir permeability and fracture conductivity over the practical producing life of low permeability geopressured reservoirs has resulted in the following observations:

1. Field evidence of reservoir effective permeability degradation with even short production time can often be observed in geopressured reservoirs.
2. Quantitative evaluation of the field production performance of hydraulic fractures in both normal and geopressured reservoirs have resulted in the observation that the fracture conductivity of hydraulically fractured wells commonly decreases with production time.
3. Multiphase fracture flow has been demonstrated to dramatically reduce the effective conductivity of fractures.
4. Pre-fracture estimates of formation effective permeability derived from pressure transient tests or production analyses are often not representative of the reservoir effective permeability exhibited in the post-fracture production performance.

The analysis of production data of wells to determine productivity has been used for almost fifty years in an effort to determine in advance what the response of a well will be to production-stimulation treatment. A discourse on early techniques may be found in the paper presented by R. E. Gladfelter, entitled "Selecting Wells Which Will Respond to Production-Simulation Treatment," Drilling and Production Procedures, API (American Petroleum Institute), Dallas, Tex., 117–129 (1955). The pressure-transient solution of the diffusivity equation describing oil and gas flow in the reservoir is commonly used, in which the flow rate normalized pressure drops are given by:

$$(P_i - P_{wf})/q_o, \text{ and}$$

$$\{P_p(P_i) - P_p(P_{wf})\}/q_g,$$

for oil and gas reservoir analyses, respectively, wherein:

$P_i$ is the initial reservoir pressure (psia), $P_{wf}$ is the sandface flowing pressure (psia)

$q_o$ is the oil flow rate (STB/D)

$P_p$ is the pseudopressure function, psia$^2$/cp and $q_g$ is the gas flow rate (Mcsf/D).

While analysis of production data using flow rate normalized pressures and the pressure transient solutions work reasonably well during the infinite-acting radial flow regime of unfractured wells, boundary flow results have indicated that the production normalization follows an exponential trend rather than the logarithmic unit slope exhibited during the pseudosteady state flow regime of the pressure-transient solution.

Throughout most of the production history of a well, a terminal pressure is imposed on the operating system, whether it is the separator operating pressure, sales line pressure, or even atmospheric pressure at the stock tank. In any of these cases, the inner boundary condition is a Dirichlet condition (specified terminal pressure). Whether the terminal pressure inner boundary condition is specified at some point in the surface facilities or at the sandface, the inner boundary condition is Dirichlet and the rate-transient solutions are typically used. It is also well known that at late production times the inner boundary condition at the bottom of the well bore is generally more closely approximated with a constant bottomhole flowing pressure rather than a constant rate inner boundary condition.

An additional problem that arises in the use of pressure-transient solutions as the basis for the analysis of production data is the quantity of noise inherent in the data. The use of pressure derivative functions to reduce the uniqueness problems associated with production data analysis of fractured wells during the early fracture transient behavior even further magnifies the effects of noise in the data, commonly requiring smoothing of the derivatives necessary at the least or making the data uninterpretable at the worst.

There have been numerous attempts to develop more meaningful production data analyses in an effort to maximize the production level of fractured wells. One such example is shown and described in U.S. Pat. No. 5,960,369 issued to B. H. Samaroo, describing a production profile predictor method for a well having more than one completion wherein the process is applied to each completion provided that the well can produce from any of a plurality of zones or in the event of multiple zone production, the production is commingled.

From the foregoing, it can be determined that production of fractured wells could be enhanced if production performance could be properly utilized to determine fracture efficiency. However, to date no reliable method for generating meaningful data has been devised. The examples of the prior art are at best speculative and have produced unpredictable and inaccurate results.

SUMMARY OF THE INVENTION

The subject invention is a method of and process for evaluating reservoir intrinsic properties, such as reservoir effective permeability, radial flow steady-state skin effect, reservoir drainage area, and dual porosity reservoir parameters omega (dimensionless fissure to total system storativity) and lambda (matrix to fissure crossflow parameter) of the individual unfractured reservoir layers in a multilayer commingled reservoir system using commingled reservoir production data, such as wellhead flowing pressures, temperatures and flow rates and/or cumulatives of the oil, gas, and water phases, and production log information (or pressure gauge and spinner survey measurements). The method and process of the invention also permit the evaluation of the hydraulic fracture properties of the fractured reservoir layers in the commingled multilayer system, i.e., the effective fracture half-length, effective fracture conductivity, permeability anisotropy, reservoir drainage area, and the dual porosity reservoir parameters omega and lambda. The effects of multiphase and non-Darcy fracture flow are also considered in the analysis of fractured reservoir layers.

The subject invention is directed to a method of and process for fractured well diagnostics for production data analysis for providing production optimization of reservoir completions via available production analysis and production logging data. The method of the invention is a quantitative analysis procedure for reservoir and fracture properties using commingled reservoir production data, production logs and radial flow and fractured interval analyses. This permits the in situ determination of reservoir and fracture properties for permitting proper and optimum treatment placement and design of the reservoir. The invention provides a rigorous analysis procedure for multilayer commingled reservoir production performance. Production logging data is used to correctly allocate production to each completed interval and defined reservoir zone. This improves the stimulation and completion design and identifies zones to improve stimulation.

The subject invention is a computational method and procedure for computing the individual zone production histories of a commingled multi-layered reservoir. The data used in the analysis are the commingled well production data, the wellhead flowing temperatures and pressures, the complete wellbore and tubular goods description, and production log information. This data is used to construct the equivalent individual layer production histories. The computed individual completed interval production histories that are generated are the individual layer hydrocarbon liquid, gas, and water flow rates and cumulative production values, and the mid-completed interval wellbore flowing pressures as a function of time. These individual completed interval production histories can then be evaluated as simply drawdown transients to obtain reliable estimates of the in situ reservoir effective permeability, drainage area, apparent radial flow steady-state skin effect and the effective hydraulic fracture properties, namely, half-length and conductivity.

Typically, an initial production log is run soon after a well is put on production and the completion fluids have been produced back from the formation. Depending on the formation, the stimulation/completion operations performed on the well and the size and productive capacity of the reservoir, a second production log is run after a measurable amount of stabilized production has been obtained from the well. Usually, additional production logs are run at periodic intervals to monitor how the layer flow contributions and wellbore pressures continue to vary with respect to production time. The use of production logs in this manner provides the only viable means of interpreting commingled reservoir production performance without the use of permanent downhole instrumentation.

The subject invention is directed to the development of a computational model that performs the production allocation of the individual completed intervals in a commingled reservoir system using the fractional flow rates of the individual completed intervals, determined from production logs and the commingled system total well fluid phase flow rates. The individual completed interval flow rate histories generated include the individual completed interval fluid phase flow rates and cumulative production values as a function of production time, as well as the mid-zone wellbore flowing pressures. The computed mid-zone flowing wellbore pressures at the production time levels of the production log runs are then compared with the actual measured wellbore pressures at those depths and time level to ascertain which wellbore pressure traverse model most closely matches the measured pressures.

The identified wellbore pressure traverse model is then used to model the bottom hole wellbore flowing pressures for all of the rest of the production time levels for which there are not production log measurements available. This use of the identified pressure traverse model to generate the unmeasured wellbore flowing pressure is the only assumption required in the entire analysis. It is fundamentally sound unless there are dramatic changes in the character of the produced well fluids or in the stimulation/damage of the completed intervals which is not reflected in the composite production log history, primarily due to inadequate sampling of the changes in the completed intervals producing fractional flow rates. With an adequate sampling of the changing fractional flow rate contributions of the individual completed intervals in a commingled reservoir, this analysis technique is superior to other multi-layer testing and analysis procedures.

The method and process of the subject invention provide a fully-coupled commingled reservoir system analysis model for allocating the commingled system production data to the individual completed intervals in the well and constructing wellbore flowing pressure histories for the individual completed intervals in the well. No assumptions are required to be made as to the stimulation/damage steady-state skin effect, effective permeability (or formation conductivity), initial pore pressure level, drainage area extent, or intrinsic formation properties of the completed intervals in a commingled reservoir system. The method of the invention considers only the actual measured response of the commingled system using production logs and industry accepted wellbore pressure traverse computational models.

The fundamental basis for the invention is a computationally rigorous technique of computing the wellbore pressure traverses to the midpoints (or other desired points) of each completed interval using one or more of a number of petroleum industry accepted wellbore pressure traverse computational methods in combination with the wellbore tubular configuration and geometry, wellbore deviation survey information, completed interval depths and perforation information, wellhead measured production rates (or cumulatives) and the wellhead pressures and temperatures of the commingled multilayer reservoir system performance. The computed pressure traverse wellbore pressures are compared with the measured wellbore pressures of either a production log or a wellbore pressure survey. This permits the identification of the pressure traverse computational method that results in the best agreement with the physical measurements made.

The invention permits the use of information from multiple production logs run at various periods of time over the producing life of the well. The invention also permits the specification of crossflow between the commingled system reservoir layers in the wellbore. The invention evaluates the pressure traverse in each wellbore segment using the fluid flow rates in that wellbore section, the wellbore pressure at the top of that wellbore section, and the temperature and fluid density distributions in that section of the wellbore traverse. The method and process of the invention actually uses downhole physical measurements of the wellbore flowing pressures, temperatures, fluid densities, and the individual reservoir layer flow contributions to accurately determine the production histories of each of the individual layers in a commingled multilayer reservoir system. The results of the analysis of the individual reservoir layers can be used with the commingled reservoir algorithm to reconstruct a synthetic production log to match with the actual recorded production logs that are measured in the well. The invention has an automatic Levenberg-Marquardt non-linear minimization procedure that can be used to invert these production history records to determine the individual completed interval fracture and reservoir properties. The invention also has the option to automatically re-evaluate the initially specified unfractured completed intervals that indicate negative radial flow steady-state skin effects as finite-conductivity vertically fractured completed intervals.

The method and process of the subject invention permits for the first time a reliable, accurate, verifiable computationally rigorous analysis of the production performance of a well completed in a multilayer commingled reservoir system using physically measured wellbore flow rates, pressures, temperatures, and fluid densities from the production logs or spinner surveys and pressure gauges to accomplish the allocation of the flow rates in each of the completed reservoir intervals. The combination of the production log information and the wellbore traverse calculation procedures results in a reliable, accurate continuous representation of the wellbore pressure histories of each of the completed intervals in a multilayer commingled reservoir system. The results may then be used in quantitative analyses to identify unstimulated, under-stimulated, or simply poorly performing completed intervals in the wellbore that can be stimulated or otherwise re-worked to improve productivity. The invention may include a full reservoir and wellbore fluids PVT (Pressure-Volume-Temperature) analysis module.

DETAILED DESCRIPTION OF THE PREFERRED EMBODIMENTS

The subject invention is directed to a computational model for computing the wellbore pressure traverses and individual layer production contributions of the individual completed intervals in a commingled reservoir. Direct physical measurements of the individual layer flow contributions to the total well production and the actual wellbore flowing pressures are recorded and included in the analysis. There are numerous wellbore pressure traverse models available for computing the bottom hole flowing and static wellbore pressures from surface pressures, temperatures and flow rates, as will be well known to those skilled in the art. The selection of the appropriate pressure traverse model is determined by comparison with the actual wellbore pressure measurements. In a commingled reservoir the layer fractional flow contribution to the total well production rate also commonly varies with respect to time. There are many factors that govern the individual layer contributions to the total well production rate with respect to time. Among these are differences in the layer initial pressures, effective permeability, stimulation or damage steady-state skin effect, drainage area, net pay thickness, and the diffusivity and storativity of the different layers. Other factors that are not directly reservoir-controlled that affect the contribution of each of the layers to the commingled reservoir well production are the changing wellbore pressures, completion losses and changing gas and liquid produced fluid ratios with respect to time.

Production logs (PLs) provide a direct means of measuring the wellbore flowing pressures, temperatures, and actual reservoir layer flow contributions at specific points in time, with which to calibrate the computed pressure traverse models. It is preferable to run multiple production logs on wells producing commingled reservoirs to track the variation in the individual completed interval contributions with respect to production time.

It is known that the commingled system total production rate commonly does not equal or even come close to equaling the sum of the individual completed interval isolated flow rates when each interval is tested in isolation from the other completed intervals in the well. There are several factors causing this, including but not limited to (1) invariably higher flowing wellbore pressures present in the commingled system across each of the completed intervals than when they were measured individually, and (2) possible crossflow between the completed intervals.

Figure 1:
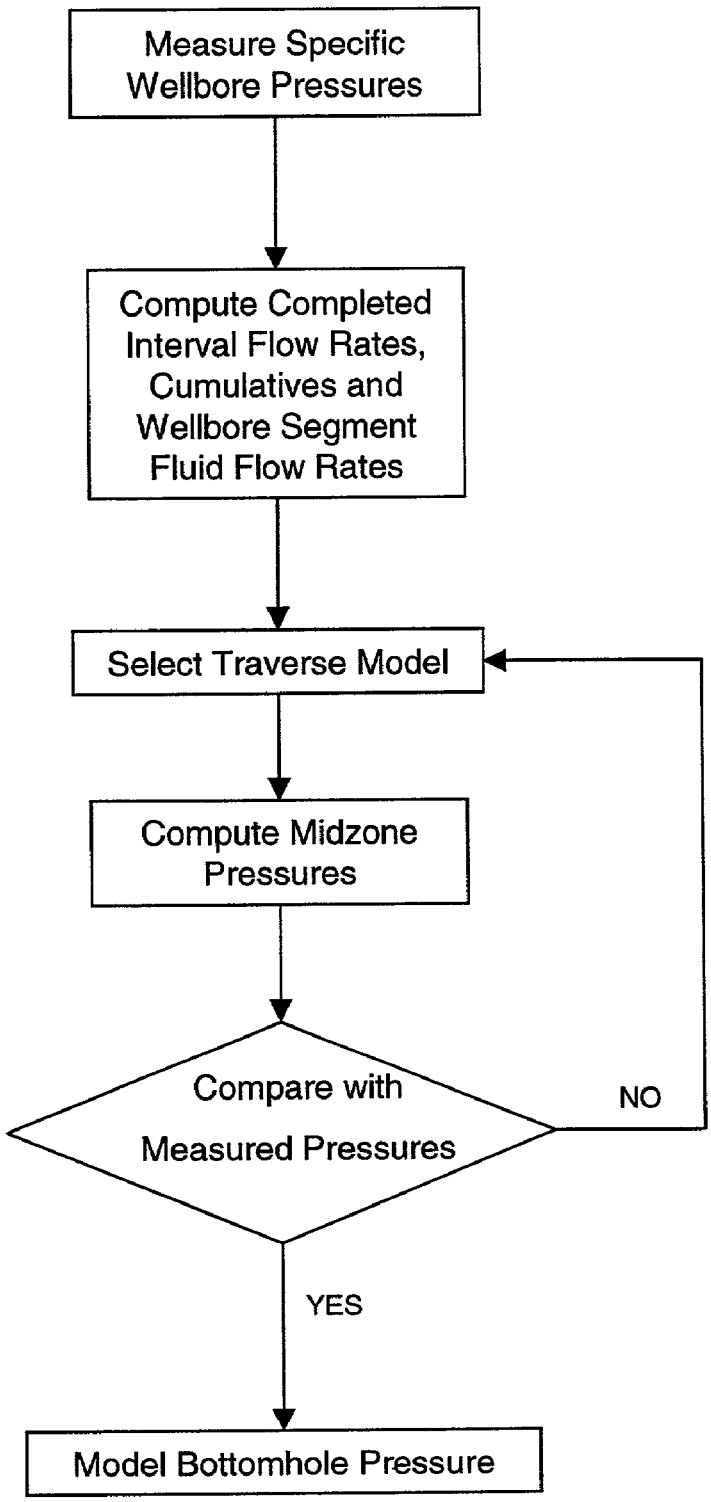
FIG. 1 is a flow chart of the process of the subject invention.

As more particularly shown in the flowchart of FIG. 1, the subject invention is directed to a computational model that performs the production allocation of the individual completed intervals in a commingled reservoir system using the fractional flow rates of the individual completed intervals, determined from the production logs and the commingled system total well fluid phase flow rates. This depicts the analysis process for a reservoir with three completed reservoir layers in which the upper and lower reservoir layers have been hydraulically fractured. The middle reservoir completed interval has not been fracture stimulated. The wellbore pressure traverse is computed using the total well commingled production flow rates to the midpoint of the top completed interval. Then the fluid flow rates in the wellbore between the midpoint of the top and middle completed intervals are evaluated using the total fluid phase flow rates of the commingled system minus the flow rates from the top completed interval. The pressure traverse in the wellbore between the midpoints of the middle and lower completed intervals is evaluated using the fluid phase flow rates that are the difference between the commingled system total fluid phase flow rates and the sum of the phase flow rates from the top and middle completed intervals. The individual completed interval flow rate histories generated in this analysis include the individual completed interval fluid flow rates and cumulative production values as a function of production time, as well as the mid-zone wellbore flowing pressures. The computed mid-zone flowing wellbore pressures at the production time levels of the production log runs are then compared with the actual measured wellbore pressures at those depths and time level to ascertain which wellbore pressure traverse model most closely matches the measured pressures.

The identified wellbore pressure traverse model is then used to model the bottomhole wellbore flowing pressure for all of the rest of the production time levels for which there are not production log measurements available. This use of the identified pressure traverse model to generate the unmeasured wellbore flowing pressures is the only major assumption made in the process. It is fundamentally sound unless there are dramatic changes in the character of the produced well fluids or in the stimulation/damage of the completed intervals which is not reflected in composite production log history, primarily due to inadequate sampling of the changes in the completed intervals producing fractional flow rates. With an adequate sampling of the changing fractional flow rate contributions of the individual completed intervals in a commingled reservoir, this analysis technique produces accurate results.

Figure 2:
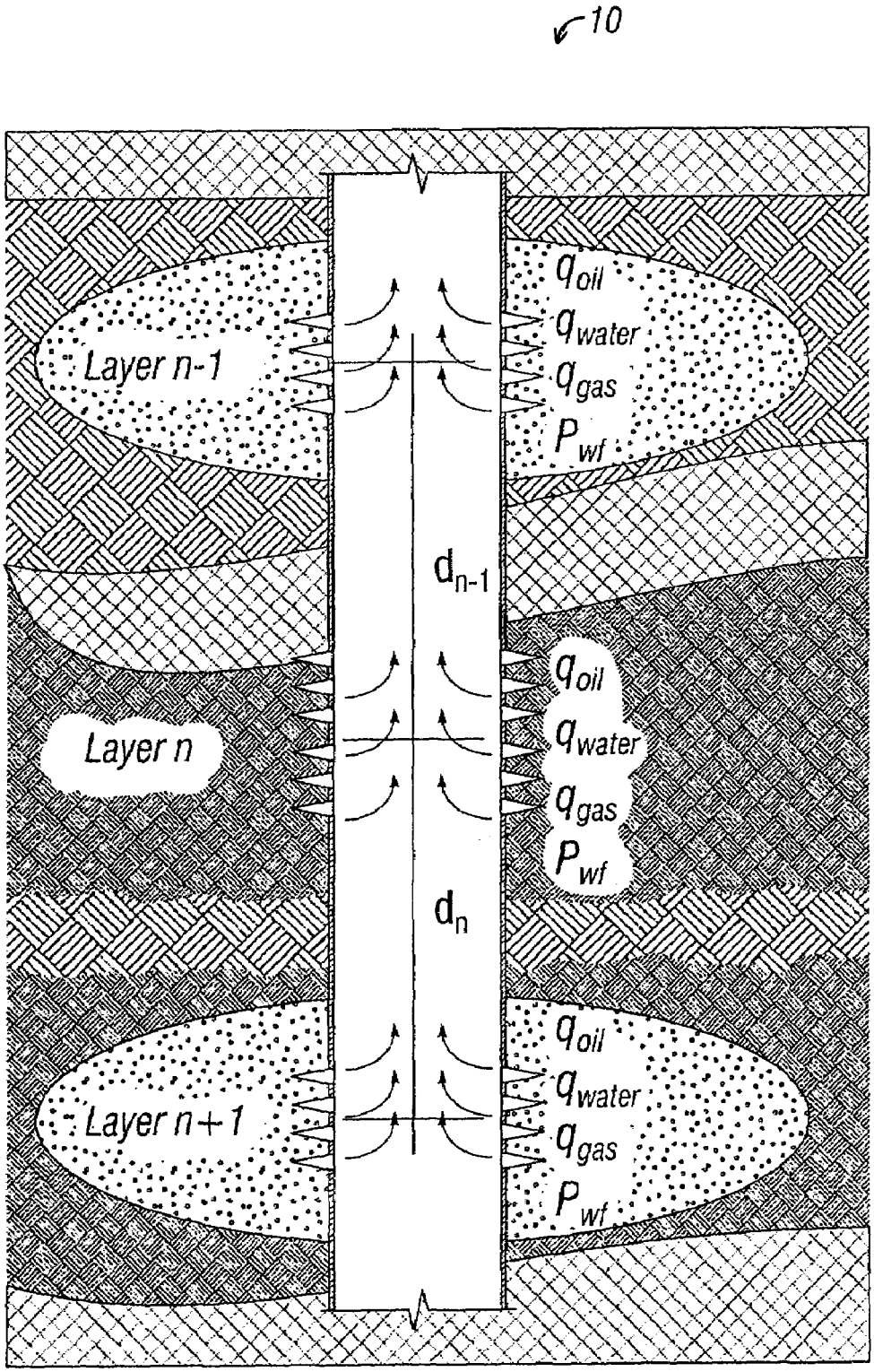
FIG. 2 is an illustration of the systematic and sequential computational procedure in accordance with the subject invention.

FIG. 2 is an illustration of the systematic and sequential computational procedure in accordance with the subject invention. Beginning at the wellhead 10, the pressure traverses to the midpoint of each completed interval are computed in a sequential manner. The fluid flow rates in each successively deeper segment of the wellbore are decreased from the previous wellbore segment by the production from the completed intervals above that segment of the wellbore. The mathematical relationships that describe the fluid phase flow rates (into or out) of each of the completed intervals in the wellbore are given as follows for oil, gas, and water production of the $j^{th}$ completed interval, respectively:

$$q_{oj}(t)=q_{ot}(t)f_{oj}(t),$$

$$q_{gi}(t)=q_{gt}(t)f_{gj}(t),$$

$$q_{wj}(t)=q_{wt}(t)f_{wj}(t),$$

where:

- $q_{oj}$ is the $j^{th}$ completed interval hydrocarbon liquid flow rate, STB/D,
- $q_{of}$ is the composite system hydicarbon liquid flow rate, STB/D,
- $f_{oj}$ is the $j^{th}$ completed interval hydrocarbon liquid flow rate liquid contribution of the total well hydrocarbon liquid flow rate, fraction,
- $q_{gi}$ is the $j^{th}$ interval gas flow rate, Mcsf/D
- j is the index of completed intervals,
- $q_{gt}$ is the composite system total well gas flow rate, Mscf/D,
- $f_{gj}$ is the $j^{th}$ completed interval gas flow rate fraction of total well gas flow rate, fraction,
- $q_{wj}$ is the $j^{th}$ interval water flow rate, STB/D
- $q_{wt}$ is the composite system total well water flow rate, STB/D
- $f_{wj}$ is the $j^{th}$ completed interval water flow rate fraction of total well water flow rate, fraction.

The corresponding fluid phase flow rates in each segment of the weilbore are also defined mathematically with the relationships as follows for oil, gas and water for the $n^{th}$ wellbore pressure traverse segment, respectively.

$$q_{on}(t) = q_{ot}(t) - \sum_{j=1}^{n-1} q_{oj}(t) \quad n>1$$

$$q_{gn}(t) = q_{gt}(t) - \sum_{j=1}^{n-1} q_{gj}(t) \quad n>1$$

$$q_{wn}(t) = q_{wt}(t) - \sum_{j=1}^{n-1} q_{wj}(t) \quad n>1$$

The flow rate and pressure traverse computations are performed in a sequential manner for each wellbore segment, starting at the surface or wellhead 10 and ending with the deepest completed interval in the wellbore, for both production and injection scenarios. The wellbore flow rate and pressure traverse calculation procedures employed permit the evaluation of production, injection or shut in wells.

The fundamental inflow relationships that govern the transient performance of a commingled multi-layered reservoir are fully honored in the analysis provided by the method of the subject invention. Assuming that accurate production logs are run in a well, when a spinner passes a completed interval without a decrease in wellbore flow rate (comparing wellbore flow rates at the top and bottom of the completed interval, higher or equal flow rate at the top than at the bottom), no fluid is entering the interval from the wellbore (no loss to the completed interval, i.e., no cross-flow). Secondly, once the minimum threshold wellbore fluid flow rate is achieved to obtain stable and accurate spinner operation, all higher flow rate measurements are also accurate. Lastly, the sum of all of the completed interval contributions equals the commingled system production flow rates for both production and injection wells.

In the preferred embodiment of the invention, two ASCII input data files are used for the analysis. One file is the analysis control file that contains the variable values for defining how the analysis is to be performed (which fluid property and pressure traverse correlations are uses, as well as the wellbore geometry and production log information). The other file contains commingled system wellhead flowing pressures and temperatures, and either the individual fluid phase flow rates or cumulative production values as a function of production time.

Upon execution of the analysis two output files are generated. The general output file contains all of the input data specified for the analysis, the intermediate computational results, and the individual completed interval and defined reservoir unit production histories. The dump file contains only the tabular output results for the defined reservoir units that are ready to be imported and used in quantitative analysis models.

The analysis control file contains a large number of analysis control parameters that use can be used to tailor the production allocation analysis to match most commonly encountered wellbore and reservoir conditions.

The invention claimed is:

1. A method for providing production optimization of reservoir completions having a plurality of completed intervals via available production analysis and production logging data provides a quantitative analysis procedure for reservoir and fracture properties of a commingled reservoir system, comprising the steps of:

a. measuring pressure for specific completed intervals in said commingled reservoir;

b. selecting a pressure traverse model;

c. computing midzone pressures using the traverse model;

d. comparing the computed midzone pressures with the measured pressures;

e. modeling the bottomhole pressure of the reservoir based on the traverse model, wherein the comparison step includes accepting the comparison if the computed midzone pressures are within a predefined tolerance of the measured pressures and rejecting the comparison if the computed midzone pressures are outside of the predefined tolerance, and wherein upon rejection, the selecting step, the computing step, and the comparing step are repeated until acceptance is achieved.

2. The method of claim 1, wherein the commingled reservoir is separated to defined said plurality of completed intervals from top to bottom including at least a top completed interval, a second completed interval and a lower completed interval, each completed interval having a top point, midpoint and a bottom point, and wherein the midzone pressure is computed using total reservoir commingled production flow rates to the midpoint of the top completed interval.

3. The method of claim 2, further comprising the step of measuring fluid phase flow rates for specific completed intervals in said commingled reservoir, wherein the fluid phase flow rates between the midpoint of the top and the second completed intervals are computed using total fluid phase flow rates of the commingled reservoir minus the flow rates from the top completed interval.

4. The method of claim 3, wherein the pressure traverse in the wellbore between the midpoints of the second and lower completed intervals is computed using fluid phase flow rates that are the difference between the commingled reservoir system total fluid phase flow rates and the sums of the fluid phase flow rates from the top and second completed intervals.

5. The method of claim 4, wherein the mathematical relationships that describe the fluid phase flow rates of each of the completed intervals for oil, gas, and water production of the jcompleted interval are as follows:

$$q_{oj}(t)=q_{ot}(t)f_{oj}(t),$$

$$q_{gj}(t)=q_{gt}(t)f_{gj}(t),$$

$$q_{wj}(t)=q_{wt}(t)f_{wj}(t),$$

where:

$q_{oj}$ is the $j^{th}$ completed interval hydrocarbon liquid flow rate, STB/D, $q_{ot}$ is the composite system hydrocarbon liquid flow rate, STB/D, $f_{oj}$ is the $j^{th}$ completed interval hydrocarbon liquid flow rate contribution of the total well hydrocarbon liquid flow rate, fraction, $q_{gj}$ is the $j^{th}$ completed interval gas flow rate, Mscf/D, j is the index of completed intervals, $q_{gt}$ is the composite system total well gas flow rate, Mscf/D, $f_{gj}$ is the $j^{th}$ completed interval gas flow rate contribution of the total well gas flow rate, fraction, $q_{wj}$ is the $j^{th}$ completed interval water flow rate, STB/D $q_{wt}$ is the composite system total well water flow rate, STB/D, $f_{wj}$ is the jcompleted interval water flow rate contribution of the total well water flow rate, fraction.

6. The method of claim 5, wherein the corresponding fluid phase flow rates in each interval of the wellbore are defined mathematically for oil, gas and water for the nth wellbore pressure traverse segment as follows:

$$q_{on}(t) = q_{ot}(t) - \sum_{\substack{j=1 \\ n>1}}^{n-1} q_{oj}(t)$$

$$q_{gn}(t) = q_{gt}(t) - \sum_{\substack{j=1 \\ n>1}}^{n-1} q_{gj}(t)$$

$$q_{wn}(t) = q_{wt}(t) - \sum_{\substack{j=1 \\ n>1}}^{n-1} q_{wj}(t).$$

7. The method of claim 3 wherein the fluid phase flow rate and pressure traverse computation in the computation step are performed in a sequential manner for each interval, starting at the wellhead and proceeding to the deepest completed interval.

8. The method of claim 3, wherein the measured fluid phase flow rates are obtained from spinner measurements or from production logs.

9. The method of claim 3, wherein the measured fluid phase flow rates are obtained from permanent downhole flow meter measurements or spinner survey measurements.

10. The method of claim 1, wherein the measured pressures of step a are obtained from production logs or from pressure gauge recordings.

11. The method of claim 1, wherein the measured pressures of step a are permanent downhole gauge measurements.

* * * * *